US010870927B2

(12) United States Patent
Johnson

(10) Patent No.: US 10,870,927 B2
(45) Date of Patent: Dec. 22, 2020

(54) DIGITAL ELECTROSPINNING ARRAY

(71) Applicant: PALO ALTO RESEARCH CENTER INCORPORATED, Palo Alto, CA (US)

(72) Inventor: David Mathew Johnson, San Francisco, CA (US)

(73) Assignee: PALO ALTO RESEARCH CENTER INCORPORATED, Palo Alto, CA (US)

( * ) Notice: Subject to any disclaimer, the term of this patent is extended or adjusted under 35 U.S.C. 154(b) by 417 days.

(21) Appl. No.: 15/656,772

(22) Filed: Jul. 21, 2017

(65) Prior Publication Data

US 2019/0024262 A1 Jan. 24, 2019

(51) Int. Cl.

| | |
|---|---|
| ***D04C 1/02*** | (2006.01) |
| ***D01D 4/02*** | (2006.01) |
| ***D01D 5/00*** | (2006.01) |

(52) U.S. Cl.

CPC ..... *D01D 4/025* (2013.01); *D01D 5/0069* (2013.01); *D04C 1/02* (2013.01)

(58) Field of Classification Search

CPC ..... D01D 5/0069; D01D 5/0061; D01D 5/18; B29C 647/12; B29C 47/00; B29C 47/30; B29C 48/30; B29C 48/345; B29D 99/0078; D04H 1/728

See application file for complete search history.

(56) References Cited

U.S. PATENT DOCUMENTS

| | | | | |
|---|---|---|---|---|
| 6,713,011 | B2 | 3/2004 | Chu et al. | |
| 7,828,539 | B1 | 11/2010 | Beachley et al. | |
| 8,272,345 | B2 * | 9/2012 | Robertson | B05B 1/14 118/313 |
| 8,869,362 | B2 * | 10/2014 | Wijngaards | B41J 2/161 29/25.35 |
| 9,989,355 | B1 * | 6/2018 | Skinner | D01D 5/0061 |
| 2009/0162468 | A1 * | 6/2009 | Barinov | D01D 5/0092 425/145 |
| 2013/0273190 | A1 * | 10/2013 | Lee | D01D 13/02 425/174.8 E |
| 2014/0205645 | A1 * | 7/2014 | Wallace | A61K 9/0024 424/422 |
| 2015/0102704 | A1 * | 4/2015 | Jakli | H01L 41/37 310/311 |
| 2017/0260652 | A1 * | 9/2017 | Kinoshita | D01D 5/0092 |

* cited by examiner

*Primary Examiner* — Alison L Hindenlang
*Assistant Examiner* — Debjani Roy
(74) *Attorney, Agent, or Firm* — Miller Nash Graham & Dunn LLP

(57) ABSTRACT

An electrospinning system for weaving nanofibers may include a digital array of addressable nozzles electrowetted with a liquid nanofiber source material. Each nozzle in the array may include an individually controllable actuator and electrode for modulating the flowrate and charge of the liquid nanofiber source material. Through selectively applying pressure and voltage to individual nozzles, the location of the nanofiber relative to the array may be controlled through digital signals alone, without having to physically move any component of the electrospinning system. By simultaneously controlling the path of multiple nanofibers within the array, new and complex weaving patterns for braids may be achieved with enhanced strength and other properties at a scale previously unattainable.

11 Claims, 6 Drawing Sheets

DIGITAL ELECTROSPINNING ARRAY

TECHNICAL FIELD

The disclosed technology relates generally to the field of electrospinning and, more particularly, to digital electrospinning arrays with spatial addressability.

BACKGROUND

Electrospinning has been used for numerous applications, but primarily, the process has been developed to produce random mats of fibers, which can be used as membranes or other technical fabrics. These mats are generally composed of polymers, spun from either melt polymers or solutions of polymers with fiber diameters ranging from 1 nm to 1 mm.

In a basic, conventional electrospinning setup, across from a target voltage is applied to a spinning tip with an open end and filled with liquid. Surface tension normally drives the shape of a small volume of liquid. However, in the presence of strong electric fields its normal shape deforms increasingly with voltage. As the electric field's force on the liquid approaches the force of its surface tension, the shape of the liquid becomes conical with a generatrix angle near 49.3° and a rounded vertex. This shape is called a Taylor cone. At a threshold voltage, the vertex inverts and emits a stream of liquid. The stream of liquid from the Taylor cone in the region nearest the spinning tip undergoes an ohmic flow with a slow acceleration. Farther from the spinning tip up to the target, which may be grounded, the liquid has convective flow within a rapid acceleration region, which is a transitional zone for the material as it transforms from a liquid to a solid.

Although electrospinning is an ideal way to produce large lengths of small diameter fibers, it does not have sufficiently accurate control over the individual placement of fibers. Some methods have spun multiple fibers at a time and may allow for overall alignment of the fibers in a particular direction, but there is no method to individually control fibers.

In one method of constructing an electrospinning array, multiple needles are arranged in an array and wetted, meaning the entire needle array is covered in a fluid, which is allowed to flow over the needles. Each individual needle creates a fiber, and the entire array creates multiple fibers simultaneously. These needle arrays do not have control over each individual needle within the needle array, however. In another method, arrays of nozzles are used to parallelize the system, but in order to change the location of the fiber, a nozzle must be physically moved. This is similar to a traditional braiding and weaving machine, which undergoes complex mechanical motion to create complex 3D structures. The motion of the material sources is typically many orders of magnitude larger than the overall scale of the braid, which allows traditional motion approaches to be used for even mm scale braids. However, these processes do not scale down to the micron-level motion control needed for the braiding of nanofibers.

In one approach to controlling the orientation of the spun fibers, the electrical field is modulated using a macro-scale orientation of oppositely charged surfaces and moving the surfaces either along a single axis or around an axis. This approach can create interesting features, but it does not allow for interleaving. In another approach, the position of an electrospinning fluid source is carefully controlled. This method has only been able to achieve relatively short aligned electrospun fibers from melt polymers.

Therefore, in order to provide new weaving patterns and stronger braids on micron- and nano-scale levels, greater control over the placement of individual fibers relative to each other is needed in an electrospinning system at that scale.

SUMMARY

According to aspects of the present disclosure, an electrospinning system includes a digital electrowettable array of addressable nozzles through which liquid nanofiber material may flow to form menisci with electrospun nanofibers. The electrospinning system may control the location of the electrospun nanofibers without breakage by modulating the flow rate and charge of the liquid nanofiber material at each nozzle through selectively applying pressure and voltage in synchrony. The electrospinning system may produce nanoscale woven braids that were previously only achievable at larger scales. Further, the strength of braids may be increased by utilizing previously unachievable interleaving and crossing patterns.

DETAILED DESCRIPTION OF THE EMBODIMENTS

Previous systems using electrospinning nozzles or Taylor cones required physical movement of the nozzle or a counter-electrode in order to move the liquid stream electrospun from the nozzle. Many of these previous arrays look quite similar to printing systems, with complex, multi-layered structures controlling the micro-scale fluid flow. In laser printing, to digitally reproduce an image or object a dynamically altered electrostatic charge on a substrate controls the adhesion of toner to the substrate. In inkjet printing, an actuator controls ink deposition pixel-by-pixel.

Embodiments of the system of the present disclosure allow electrospun nanofibers to be moved by digital alteration of the source location along an electrowettable array of addressable nozzles through modulating the flow rate and charge of liquid nanofiber material. Control over the liquid nanofiber material may be achieved through the synchronized application of pressure and voltage at specific nozzle locations in the array. By controlling the liquid nanofiber material source of the electrospun nanofibers, an electrospun nanofiber may be moved digitally from nozzle to nozzle along a path without breaking. By digitally controlling the paths of multiple electrospun nanofibers around the array, complex braids may be woven with enhanced strength and other mechanical properties.

Figure 1:
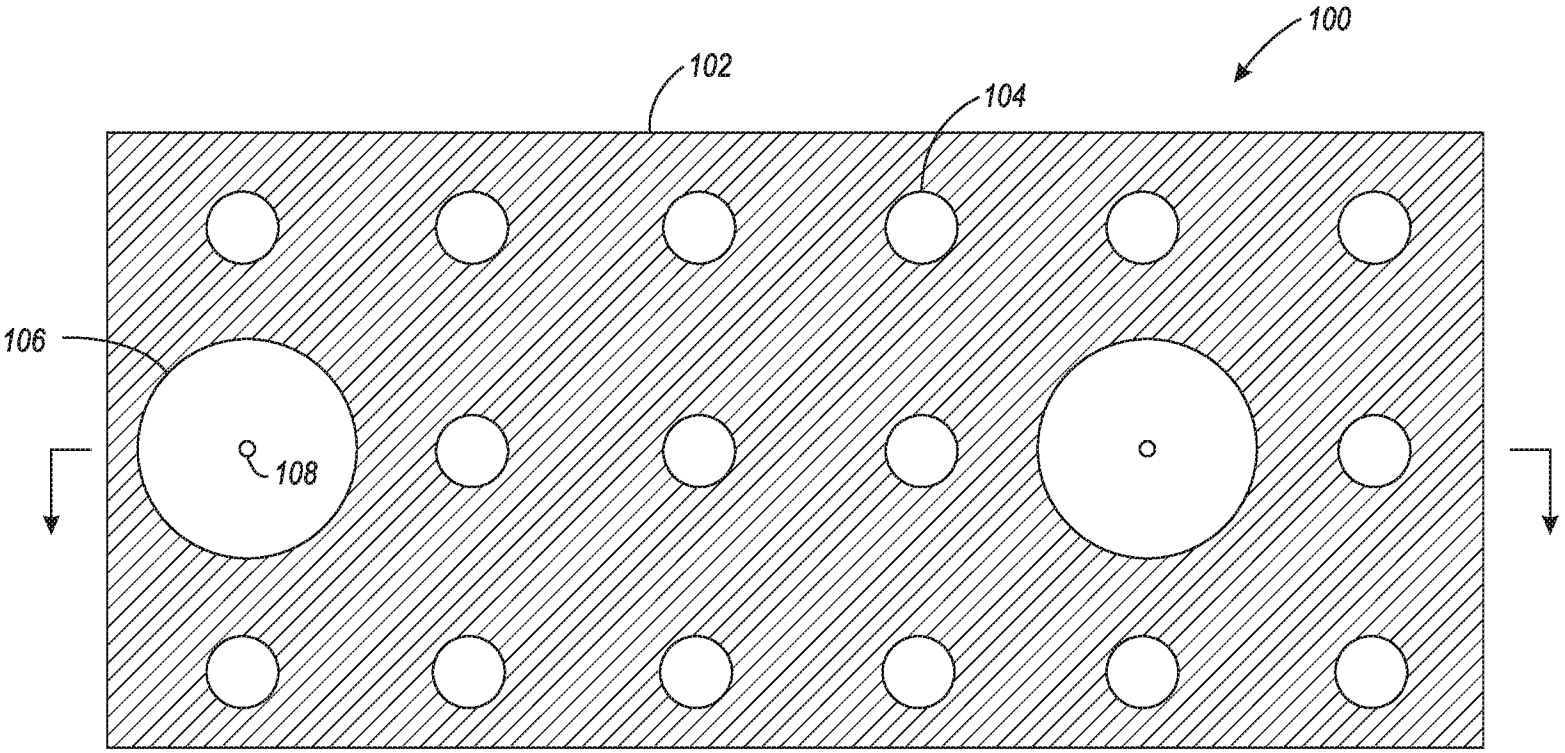
FIG. 1 is a plan view of a section of an example array of addressable electrospinning nozzles, in accordance with certain embodiments of the disclosed technology.

As shown in FIG. 1, an example system 100 for weaving electrospun nanofibers may include a digital array 102 of addressable electrospinning nozzles 104. The array 102 may be wettable by nanofiber material, such as ultra-high-molecular-weight polyethylene (UHMWPE), collagen, nylon, silicone, polyurethane, polystyrene, a polyacrylic, polyamide, a polyvinyl, a non-conductive polymer, and/or any other material that may be electrospun. The electrospinning nanofiber material may be dissolved in a solvent, such as dimethyl formamide (DMF), ethanol, formic acid, dimethylacetamide, chloroform, acetone, trifluoroacetic acid, cyclohexane, trifluoroethanol, hexafluoroisopropanol, tetrahydrofuran, or water, for example. Additionally or alternatively, the electrospinning nanofiber material may be heated to a temperature at which it is a liquid. The liquid nanofiber material forms electrospun nanofibers through developing a meniscus 106 at a nozzle 104 and becoming charged from an applied voltage such that a narrow, liquid jet stream overcomes the surface tension of the meniscus 106. This stream of liquid nanofiber material is an electrospun nanofiber 108. The array 102 may simultaneously support multiple electrospun nanofibers 108. The array 102 of nozzles 104 may be arranged in layouts that differ from the grid shown in FIG. 1, such as radially or with varying pitch range, for example. The spacing between the nozzles 104 in the array 102 may range from about 2 to about 4 times the diameter of the nozzle 104, for example. Some embodiments may include nozzles 104 with diameters ranging from about 0.1 to about 100 microns, with a mid-range around 10 microns. Each nozzle 104 may have independent control over its fluidics.

Figure 2:
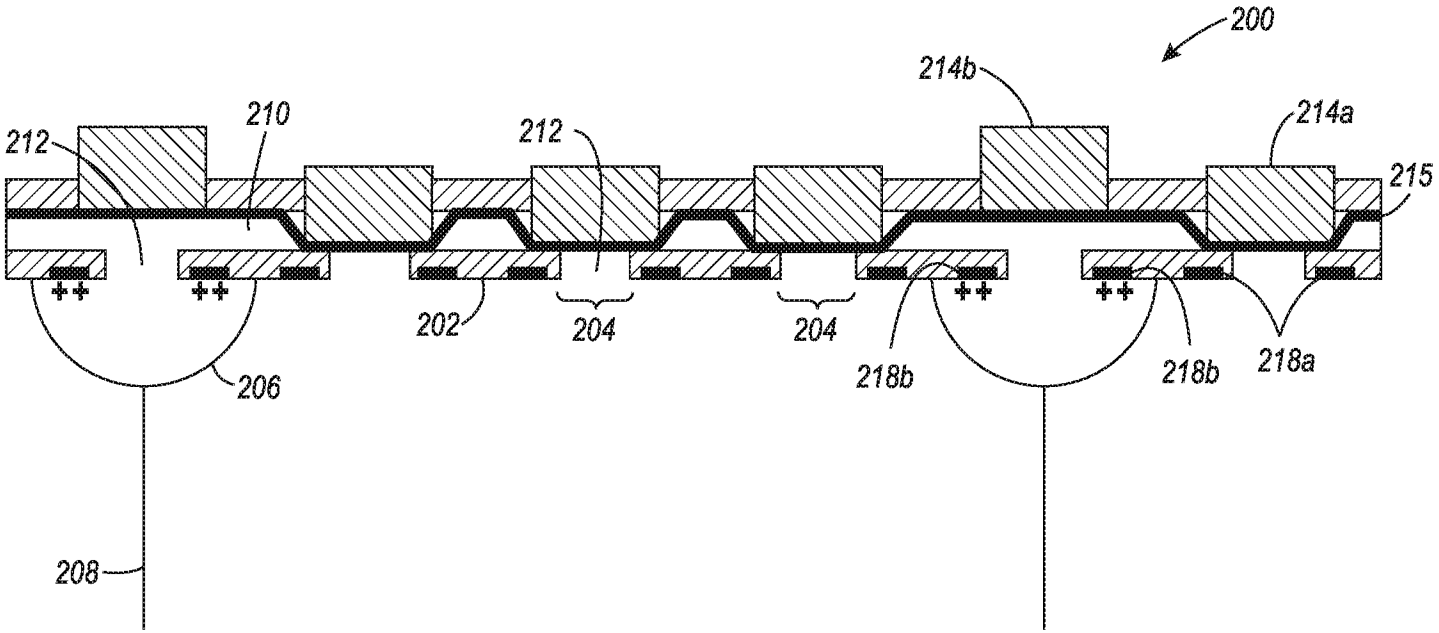
FIG. 2 is a cross-sectional side view of the example array of FIG. 1, in accordance with certain embodiments of the disclosed technology.

FIG. 2 shows a cross-sectional side view of an array section 202 for an example system 200 including addressable electrospinning nozzles 204. Each nozzle 204 in the array 202 may include a channel 210 in communication with an orifice 212, a pressure actuator 214, and an electrode 218. The liquid nanofiber material may form a meniscus 206 through the orifice 212 of the nozzle 204. The liquid nanofiber material supplies menisci 206 and electrospun nanofibers 208 as the liquid nanofiber material feeds through the channel 210 to the orifice 212 of the nozzle 204.

The electrospinning system 200 may use actuators 214 to modulate the flow rate of the liquid nanofiber material at each nozzle 204. The pressure actuator 214 may selectively apply pressure to the liquid nanofiber material at the orifice 212. In some embodiments, the actuators 214 may apply pressure up to about 900 mbar, for example, with the higher pressures for use with liquid nanofiber materials of higher polymer concentrations or larger viscosities. In some embodiments, the actuators 214 may apply pressure from about 0 mbar to about 20 mbar. The actuators 214 may be piezoelectric transducers, for example, that deform a diaphragm or membrane 215 into the channel 210 and/or orifice 212 to apply pressure to the liquid nanofiber material. The membrane 215 may be very thin, such as much less than 250 μm in thickness, for example. The membrane 215 may be a polymer, such as polyimide or polyether ether ketone (PEEK), or metal, such as stainless steel or aluminum, for example. The actuators 214 may operate in response to electrical signals. The actuators 214 may be any type of actuator capable of microfluidic pressure modulation. Applying pressure to the liquid nanofiber material using the pressure actuator 214 may cause the meniscus 206 to enlarge.

Additionally or alternatively, the pressure actuator 214 may prevent the flow of liquid nanofiber material between the channel 210 and the orifice 212. FIG. 2 shows both a closed pressure actuator 214*a*, where liquid nanofiber material is unable to flow through the orifice 212, and an open pressure actuator 214*b*, where liquid nanofiber material flows through the channel 210 and out the orifice 212 to form a meniscus 206. In this way, a digital control signal may operate the actuators 214 in either an on or off state. In some embodiments, the default state of an actuator 214 may be off until supplied with an electrical signal. When turned on, the actuator 214 opens the orifice 212 and allows a meniscus 206 to form. The flow rate of the liquid nanofiber material feed across the entire array 202 may be controlled dynamically elsewhere in the system 200 with a pump and/or other pressure application. Some embodiments may include multiple digital actuators at one nozzle 204 such that one controls the on/off state and the other controls applying additional pressure in the on state.

The electrospinning system 200 may use electrodes 218 to modulate the electrostatic charge of the liquid nanofiber material at each nozzle 204. The electrode 218 may selectively apply a voltage at the nozzle 204 to control the electrowetting behavior of the meniscus 206 of liquid nanofiber material. The applied voltage may vary depending on the design of the electrodes in the array and the rheology of the liquid nanofiber material. In some embodiments, the voltages applied by the electrodes 218 may range from about 1 kV to about 30 kV, for example. FIG. 2 shows both a non-activated electrode 218*a* and an activated electrode 218*b*, applying a voltage. The electrodes 218 may be controlled digitally.

The electrodes 218 and actuators 214 may all be connected to a controller (not shown) that synchronizes and sends operating signals to the electrodes 218 and actuators 214 based on their location in the array 202 and/or the location of the electrospun nanofibers 208. The electrical connections from the controller, a voltage source, and/or ground to the electrodes 218 and actuators 214 may be through contacts at different layers (not shown) in the system 200. The electrospinning system 200 may include sensors and/or other feedback systems for regulating applied pressures and voltages and/or detecting the location and/or characteristics of menisci 206 and/or electrospun nanofibers 208. The system 200 may also include a memory for storing location data and electroweaving pattern programs.

Figure 3:
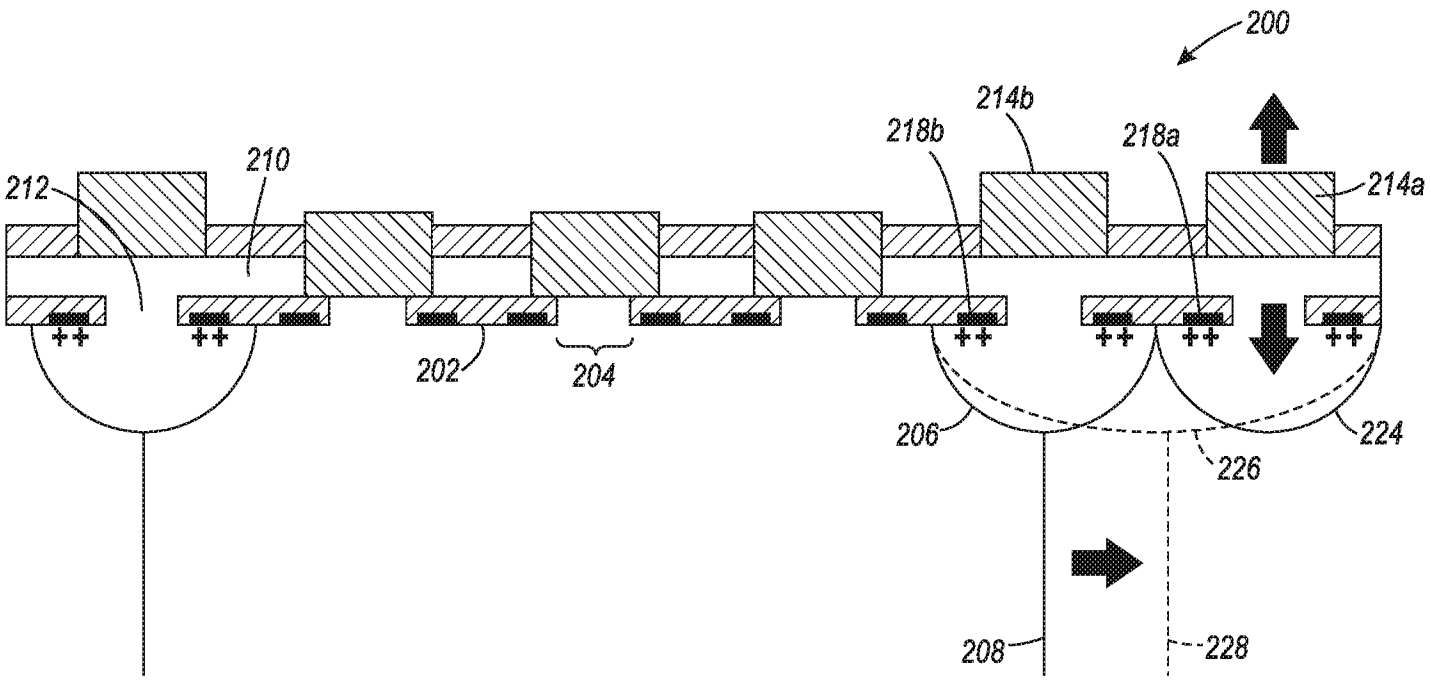
FIG. 3 is a cross-sectional side view of the example array of FIGS. 1-2 illustrating the formation of a meniscus through a nozzle, in accordance with certain embodiments of the disclosed technology.

FIG. 3 shows the first steps for moving the location of the electrospun nanofiber 208 to a different nozzle 204 in the array 202 of the electrospinning system 200. At a nozzle 204 with an already formed meniscus 206 and electrospun nanofiber 208, the open pressure actuator 214*b* may apply pressure to the liquid nanofiber material such that the meniscus 206 enlarges.

Adjacent the nozzle 204 with the already formed, now enlarged meniscus 206 and electrospun nanofiber 208, the closed pressure actuator 214*a* opens to allow flow of the liquid nanofiber material between the channel 210 and the orifice 212. The pressure actuator 214*a* may then further apply pressure to the liquid nanofiber material to form a second enlarged meniscus 224 adjacent the first enlarged meniscus 206. Additionally, the non-activated electrode 218*a* may be activated to apply a voltage to the second enlarged meniscus 224 through the material of the array 202.

As the menisci 206 and 224 enlarge, they meet and form a combined meniscus 226 with an electrospun nanofiber 228 between both adjacent nozzles 204. The voltage of the now-activated electrode 218*a* increases to the same applied voltage of the already-activated electrode 218*b*.

Figure 4:
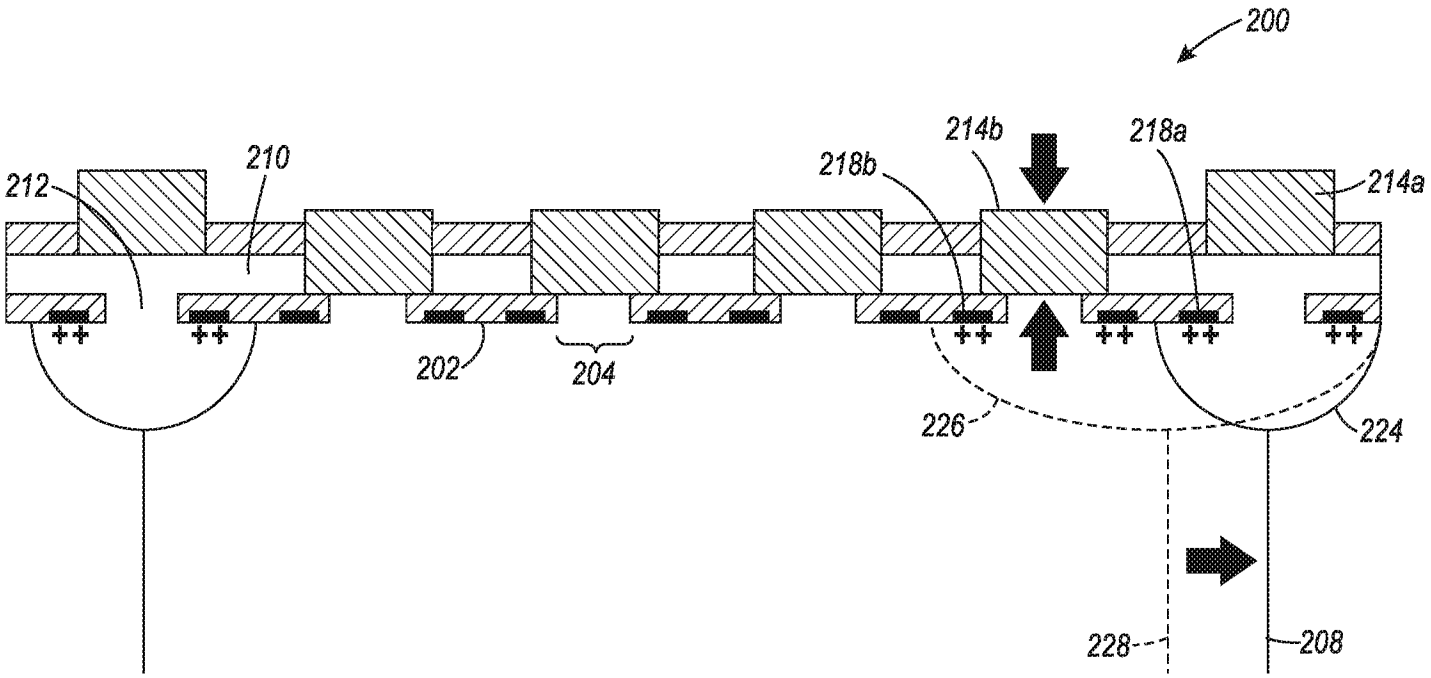
FIG. 4 is a cross-sectional side view of the example array of FIGS. 1-3 illustrating the actuation of a nozzle, in accordance with certain embodiments of the disclosed technology.

Next, as partially shown in FIG. 4, the applied voltage of the electrode 218*b* decreases to zero, and the pressure applied to the liquid nanofiber material reduces so that the combined meniscus 226 separates back out into a first meniscus 206 at the original nozzle 204 and a second meniscus 224 with the electrospun nanofiber 208 at the adjacent nozzle 204. The pressure actuator 214*b* may then close off the flow of liquid nanofiber material between the channel 210 and the orifice 212 at the nozzle 204 where the meniscus 206 and electrospun nanofiber 208 were previously.

In this way, electrospun nanofibers may be moved from nozzle 204 to nozzle 204 across the array 202 of the electrospinning system 200 without having to move any nozzles or spinnerets. The electrospinning system 200 enables digital nano- and/or micro-weaving by moving the source location of electrospun nanofibers without interrupting fiber generation. This action—switching the electrospun nanofiber 208 from one nozzle 204 to another—may be completed in microseconds or less than a millisecond such that the frequency is around 100 kHz, for example. In some embodiments, the production rate of the resulting braid of the woven electrospun nanofibers may be about 10 mm/s.

Figure 5:
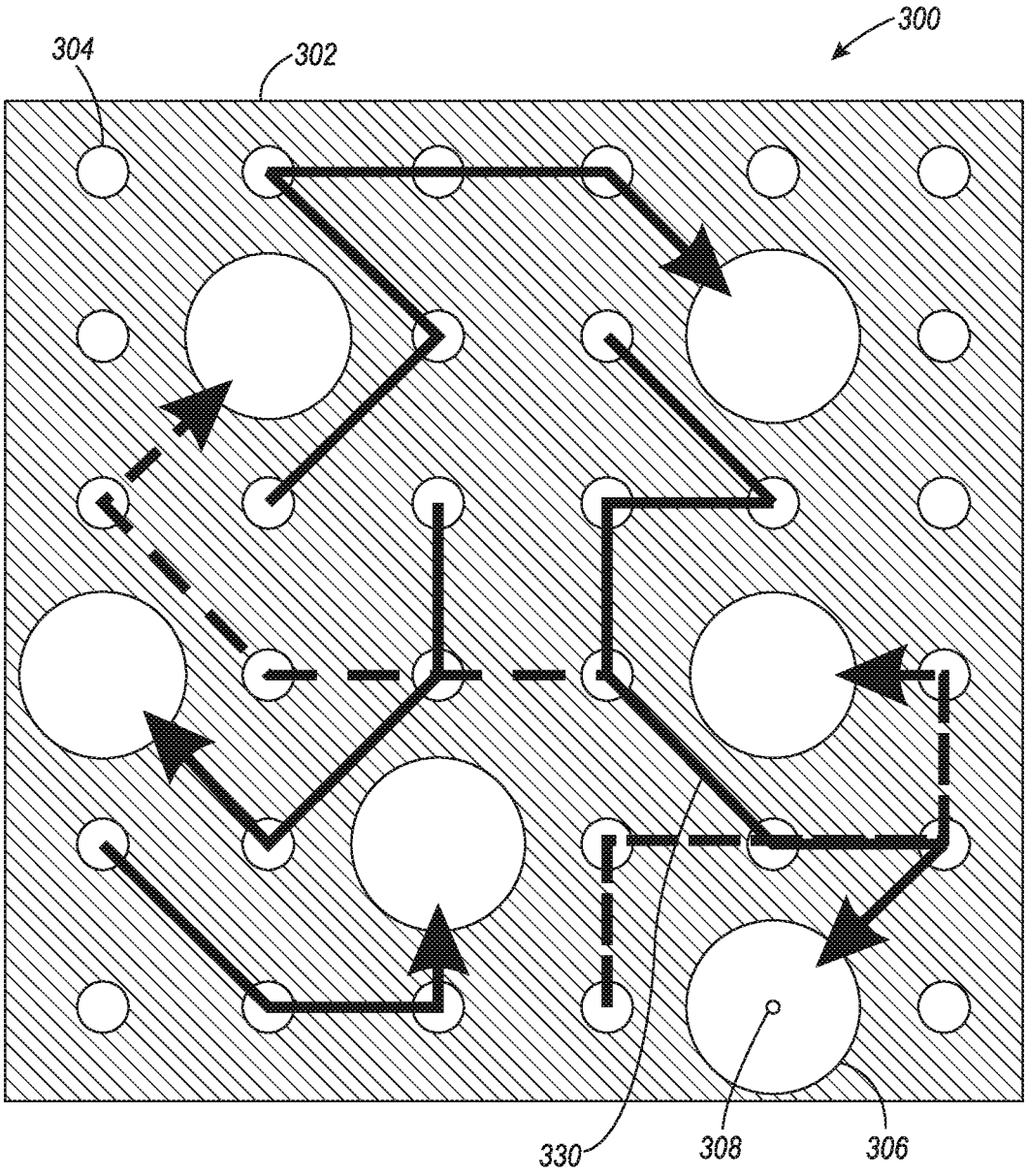
FIG. 5 is a plan view of a section of an example array of addressable electrospinning nozzles with multiple menisci illustrating the paths of the electrospun nanofibers, in accordance with certain embodiments of the disclosed technology.

As shown in FIG. 5, electrospun nanofibers 308 may follow complex paths 330 across and around an array 302 of nozzles 304 in an electrospinning system 300. The electrospun nanofibers 308 move from nozzle 304 to nozzle 304 using the menisci 306, which may be selectively created at each nozzle 304. Since the nozzles 304 are all addressable, the paths 330 may be easily programmed according to the nozzle addresses, and the electrospun nanofibers 308 may be braided and/or woven into complex patterns. Unlike mechanical systems for actuating electrospinning nozzles, these addressable nozzles can cross each other's paths and traverse the nozzle array in nearly unlimited ways. The movement of any single electrospinning source may be controlled to avoid direct interference with another electrospinning nozzle. To obtain higher efficiency from the system, it may be desirable to keep electrospinning sources a certain distance apart depending on the pitch of the nozzle array. The resulting weave of the electrospun nanofibers 308 may have enhanced strength, elasticity, flexibility, and/or other properties. Electrospun nanofibers with nanometer to micrometer diameters may be moved along specific paths to weave complex patterns of braids at the micron scale. Known patterns used in conventional braiding or weaving of rope or cable may be scaled down and translated into gridded paths.

Figure 6:
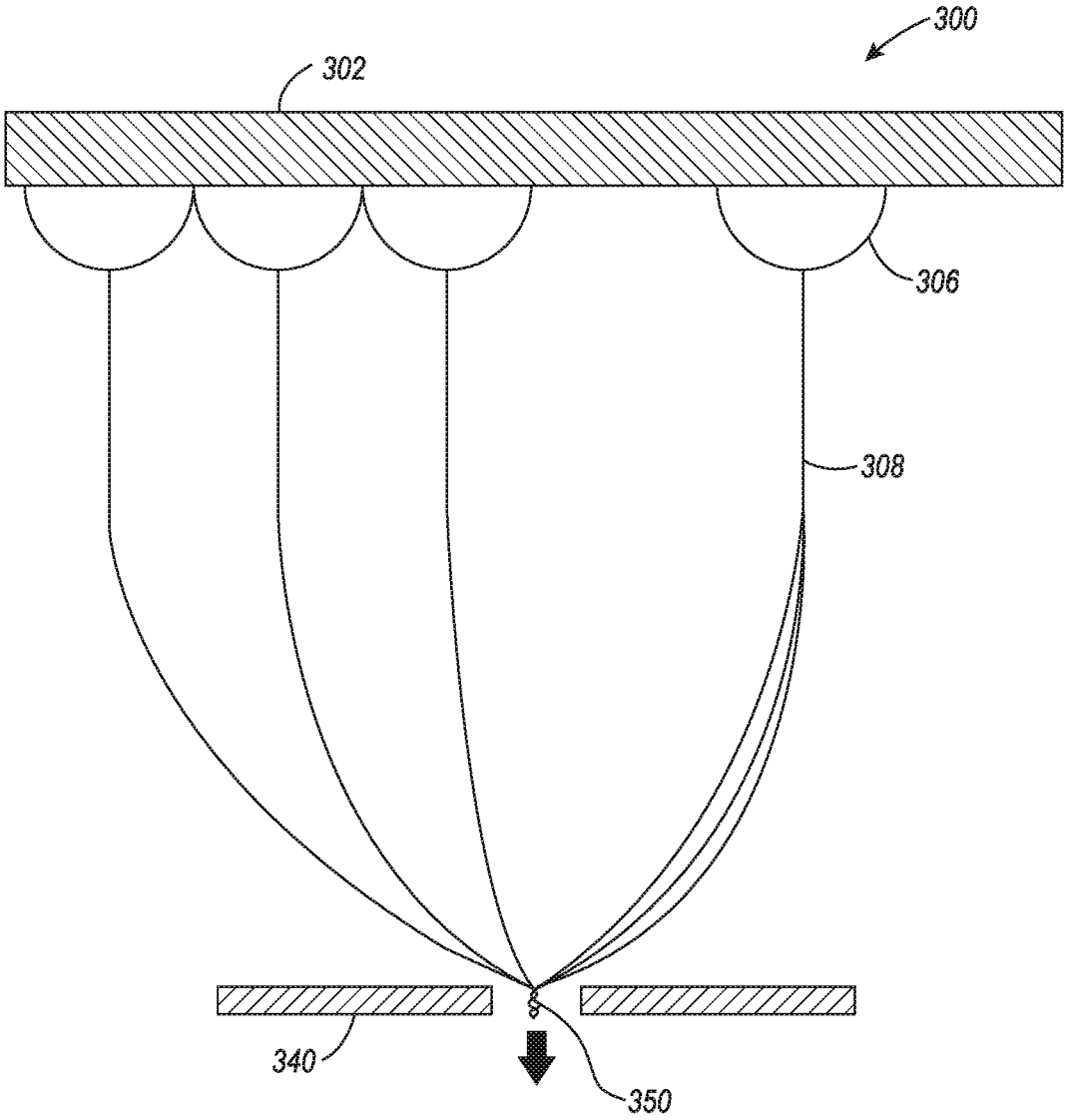
FIG. 6 is a cross-sectional side view of the example array of FIG. 5 illustrating the resulting woven product of the electrospun nanofibers, in accordance with certain embodiments of the present disclosure.

FIG. 6 shows a side view of the electrospinning system 300 of FIG. 5 with the array 302 facing a circular counter-electrode 340 with a gap in the middle, through which the resulting woven braid 350 of electrospun nanofibers 308 is collected. The counter-electrode 340 may be negatively and/or oppositely charged from the liquid nanofiber material to help attract and/or collect the electrospun nanofibers 308 and/or woven braids 350. Alternatively or additionally, the counter-electrode 340 and takeup may include a neutral plate, a flat plate with no opening, a wrap, a spool, and/or a takeup reel, in accordance with known mechanisms. The electrospinning system 300 may include multiple counter-electrodes 340 for collecting multiple woven braids 350. The distance between the array 302 and the counter-electrode 340 should be sufficient to overcome the breakdown voltage of the electric field between the array 302 and the counter-electrode 340.

Additionally or alternatively, the electrospinning system may include combined arrays featuring differing liquid nanofiber material feeds such that differing material electrospun nanofibers may be woven together to form composite braids. As another alternative, the braids of the electrospun nanofibers may undergo carbonization and/or other post-weaving treatments to further enhance the product's properties.

It will be appreciated that variants of the above-disclosed and other features and functions, or alternatives thereof, may be combined into many other different systems or applications. Various presently unforeseen or unanticipated alternatives, modifications, variations, or improvements therein may be subsequently made by those skilled in the art which are also intended to be encompassed by the following claims.

What is claimed is:

1. A system for weaving electrospun nanofibers, the system comprising:

an array of individually addressable electrospinning nozzles, the array wettable by liquid nanofiber material, each nozzle having:

an orifice for forming a meniscus of the liquid nanofiber material at the nozzle;

an electrode for selectively applying voltage at the nozzle to modulate an electrostatic charge of the liquid nanofiber material;

an actuator for selectively controlling pressure at the nozzle, the actuator responsive to electrical control signals; and a channel in communication with the nozzle and in communication with the orifice for feeding liquid nanofiber material to form the electrospun nanofibers; and a controller in communication with the electrodes and actuators for each nozzle to selectively and digitally apply and modulate the voltages to individually control the electrostatic charge at each nozzle to allow a fiber of the liquid nanofiber material to move between nozzles while being created and the controller to selectively control the actuator at each nozzle with signals separate from the signals to the electrodes to control the electrostatic charge.

2. The system of claim 1, further comprising a counter-electrode facing the array of addressable electrospinning nozzles.

3. The system of claim 1, further comprising a memory for storing addresses and weaving patterns.

4. The system of claim 1, further comprising a sensor to detect electrospun nanofibers within the array.

5. The system of claim 1, wherein the electrospinning nozzles are laid out as a rectangular grid within the array.

6. The system of claim 1, wherein the electrospinning nozzles have a diameter of about 0.1 to 100 microns.

7. The system of claim 6, wherein the electrospinning nozzles have a diameter of about 10 microns.

8. The system of claim 1, wherein the electrospinning nozzles have a diameter and the electrospinning nozzles are spaced apart within the array a distance in a range of 2 to 4 diameters.

9. The system of claim 1, wherein the electrospun nanofibers have travelled along paths relative to the array according to a weaving pattern to form a woven nanobraid.

10. The system of claim 1, wherein the actuator comprises a piezoelectric element.

11. The system of claim 10, wherein the piezoelectric element comprises a membrane.

* * * * *